US005671787A

United States Patent [19]

Wehrmann

[11] Patent Number: 5,671,787

[45] Date of Patent: Sep. 30, 1997

[54] ACCUMULATION SYSTEM AND METHOD

[75] Inventor: Rick Steven Wehrmann, Hudson, Ohio

[73] Assignee: Automated Packaging Systems, Inc., Streetsboro, Ohio

[21] Appl. No.: 507,596

[22] Filed: Jul. 26, 1995

[51] Int. Cl.[6] ..... B65B 19/00

[52] U.S. Cl. ..... 141/134; 141/131; 141/94; 53/248; 53/501; 53/506; 221/251

[58] Field of Search ..... 141/131, 134, 141/153, 94, 156–160, 183, 184; 53/248, 501, 506; 221/251

[56] References Cited

U.S. PATENT DOCUMENTS

| | | | |
|---|---|---|---|
| 825,864 | 7/1906 | Raquett . | |
| 834,446 | 10/1906 | Berg . | |
| 1,549,395 | 8/1925 | Houweling . | |
| 2,523,517 | 9/1950 | Potter | 53/501 X |
| 2,588,483 | 3/1952 | Chapman | 141/134 X |
| 2,799,432 | 7/1957 | Suppiger et al. | 141/159 X |
| 2,932,483 | 4/1960 | Dodd | 141/156 X |
| 3,129,544 | 4/1964 | Klapes et al. . | |
| 3,139,713 | 7/1964 | Merrill et al. | 53/501 X |
| 3,535,847 | 10/1970 | Strohmeier et al. | 53/501 |
| 4,161,677 | 7/1979 | Dill . | |
| 4,262,793 | 4/1981 | Hebenstreit et al. . | |
| 4,534,156 | 8/1985 | Smith . | |
| 4,570,419 | 2/1986 | Tinsley | 53/473 |
| 4,583,571 | 4/1986 | Focke et al. . | |
| 4,662,409 | 5/1987 | Egli | 141/1 |
| 5,022,444 | 6/1991 | Kendall et al. | 141/248 |

FOREIGN PATENT DOCUMENTS

| | | |
|---|---|---|
| 2395192 | 1/1979 | France . |
| 2942861 | 5/1980 | Germany . |
| 1491475 | 11/1977 | United Kingdom . |

OTHER PUBLICATIONS

EPO Search report (EP 96 30 5031).

*Primary Examiner*—J. Casimer Jacyna
*Attorney, Agent, or Firm*—Watts, Hoffmann, Fisher & Heinke Co., L.P.A.

[57] ABSTRACT

A system for sequentially establishing batches of predetermined numbers of items is disclosed. The system includes a feeder for continuously dispensing items serially and one at a time. A counter counts items as they are dispensed by the feeder and emits a batch control signal each time a predetermined number of items has been dispensed by the feeder. An item accumulator/separator separates items fed on a continuous basis into batches. The separator includes a diverter for diverting items forming each succeeding batch to a collection location separated from the location of items in the batch immediately preceding each separated batch while maintaining all items along a flow path from the feeder to a collection station. The diverter is operative to establish diversion of items of a succeeding batch in response to each such batch control signal. A collector is positioned at the collection station for sequentially collecting such batches and maintaining them in such separated condition.

27 Claims, 4 Drawing Sheets

ACCUMULATION SYSTEM AND METHOD

INTRODUCTION

This invention relates to item dispensing and accumulation and more particularly to a novel and improved accumulator system which enables continuous automatic dispensing of counted and accumulated item sets.

BACKGROUND OF THE INVENTION

With packaging and other operations vibratory feeders are used to dispense discrete items, such as parts or pills, sequentially. Typically, an automatic counter detects the items as they are sequentially dispensed and emits a signal each time a predetermined number of items have been detected.

Output signals from counters are typically used to stop the operation of the vibratory feeder. For example, if parts are being fed directly from a counter into a bag that is to be sealed to form a package, part feed will stop until a bag with a completed set of parts has been removed from a load station and replaced by a new bag to receive a subsequent set of parts. In other applications, the counted items are collected in an accumulator and the feeder will be stopped until the accumulator has been emptied and an accumulator ready signal is transmitted to the feeder.

Yet another approach to separating dispensed items into sets of predetermined numbers is the use of a diverter plate to divert items dispensed after an accumulator has collected a set of predetermined size. Typically, subsequently delivered items are diverted into a supplemental accumulator for subsequent return to the feeder and recycling through the counting procedure. Not only is such procedure wasteful, but it has other drawbacks as well. If the items being dispensed are parts of a nature which can become disfigured or indeed damaged, the quality of items being dispensed can be degraded. The diverters have other disadvantages, such as on occasion a part which is intended to be diverted will fall into the accumulator in spite of the presence of the diverter, resulting in an overcount. On other occasions, parts may bounce off the diverter and back through the counter to result in a miscount. Alternately, they may miss the secondary accumulator and fall onto the floor or go to some other undesired location. Accordingly, there is a need for a system to allow the continuous operation of an item dispenser which at the same time is capable of segregating all dispensed items into individual sets of predetermined numbers of dispensed items.

SUMMARY OF THE INVENTION

A system made in accordance with the present invention utilizes a vibratory feeder which dispenses items sequentially and one at a time. A counter is provided which detects each dispensed item and emits a signal each time a predetermined number of dispensed items have passed through the counter.

An accumulator/separator is provided which accumulates dispensed items and in response to signals received from the counter, separates the items into individual sets, each of a predetermined number. Items discharged from the accumulator/separator are gravity fed to a further receptacle which may take any one of a number of forms. The further receptacle may, for example, be an accumulator which in turn discharges the items for further processing, a receptacle on a bucket type conveyor, or a bag in which an item set is to be packaged.

The accumulator/separator includes a body having a through tubular passage which is oriented vertically to receive gravity fed dispensed and counted items. A diverter plate is positioned within the housing. A spaced pair of diverter supports are pivotally supported, respectively on opposite sides of the housing. The diverter is pivotally supported by the supports below an outlet of the housing with the plate extending upwardly from the pivotal support. The supports are pivotally movable to shift the diverter pivot support between spaced positions each adjacent a different housing end wall.

A cam follower projects upwardly from the diverter pivot outwardly of one of the supports. The cam follower engages an associated cam which is movable to coact with the cam follower and cause limited pivotal movement of the diverter about the axis of the pivot.

In use the diverter is initially positioned adjacent one end wall and items of a first batch are allowed to pass through the accumulator/separator. As the last item of the first batch passes the counter an output signal from the counter causes an actuator to shift the cam which in turn shifts the diverter to a position diagonally across the housing passage. As a result of the shifting of the diverter, the last item of the first batch is, if engaged by the diverter at all, knocked downwardly into the accumulator/separator and items of a second batch are collected between the diverter and the one wall.

Once a further receptacle beneath the accumulator/separator has received the first batch and been conditioned to receive the second batch, the support arms are pivoted to shift the diverter pivot across the housing outlet to a position adjacent the other end wall. This shifting of the diverter pivot releases the accumulated items of the second batch and positions the diverter adjacent the other end wall. As the last item of the second batch is sensed, the cam is returned to its initial position, shifting the diverter this time across the tubular passage with the top of the diverter near the one wall. A third batch is now collected atop the diverter and adjacent the other end wall.

Once the collector is conditioned to received the third batch, the diverter pivot is shifted back to its original position allowing the third batch to pass through the housing and positioning the diverter back in its original position. Once the last item of the third batch is detected the diverter is shifted to the same position it assumed to collect the second batch, a fourth batch is collected and the entire process repeats.

A receptacle condition sensor is preferably provided. The condition sensor emits a signal to indicate a receptacle which has received a batch has been emptied or replaced by a further receptacle which is prepared to receive the next succeeding batch. When the receptacle condition sensor emits a signal indicating it is prepared to received the next batch, the diverter pivot is shifted across the discharge opening to move the diverter from one of its positions across the passage to a position adjacent one of the end walls, allowing the discharge of the batch being formed.

An overfeed prevention control will stop feed from the feeder in that situation where the counter has indicated completion of a batch, but no receptacle ready signal has been received. In that situation, an operator warning is preferably emitted to indicate the system needs operator attention to correct whatever problem has caused the system to fail to operate in its intended continuous feed manner.

In setting up the system for operation, the discharge rate of the vibratory feeder is adjusted relative to the rate at which receptacles are positioned to successively receive discharged batches of counted items. Once adjusted, the feeder will operate continuously providing the advantages of minimizing the power required for feeder operation and minimizing the opportunity for feeder caused degradation to the items being dispensed while optimizing the rate of item dispensing and accumulation.

Accordingly, the objects of the invention are to provide a novel and improved dispensing system including a novel and improved accumulator/separator enabling continuous feeder operation and a method of accumulating and separating items into batches of predetermined numbers.

DESCRIPTION OF THE PREFERRED EMBODIMENT

Figure 1:
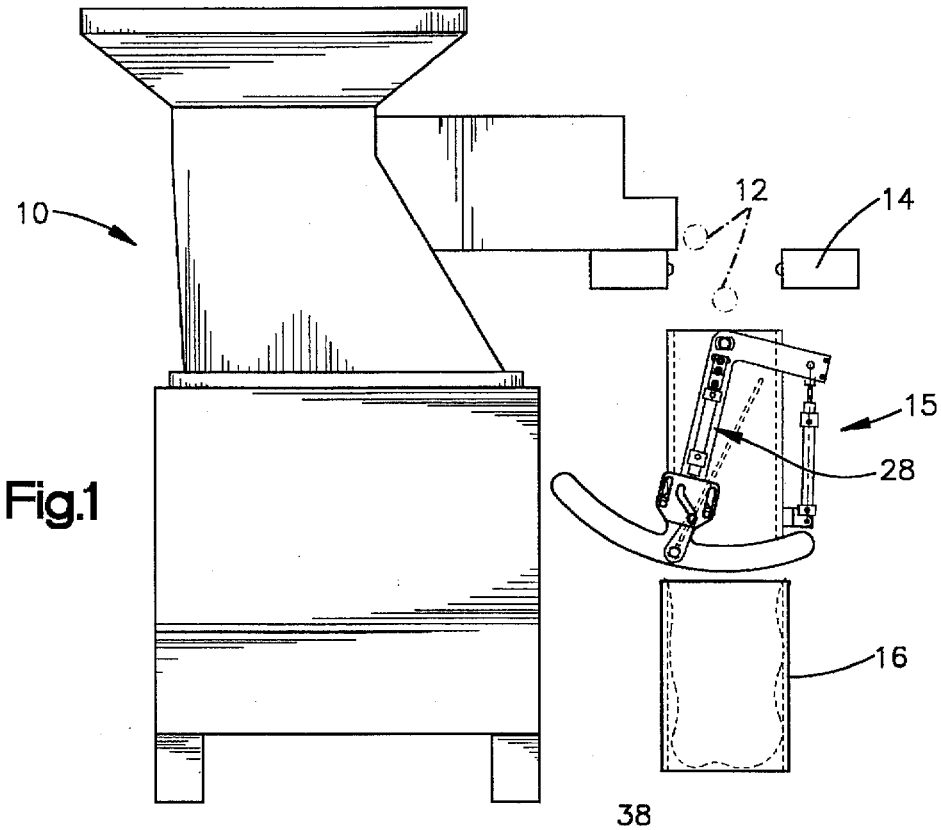
FIG. 1 is a somewhat schematic view of the system of this invention.

A vibratory feeder is shown somewhat schematically at 10 in FIG. 1. The feeder 10 dispenses items 12 which are gravity fed past a counter 14. One suitable feeder and counter system is sold by the present assignee, Automated Packaging Systems, Inc. of Streetsboro, Ohio under the designation Accu-Count DAC-1000.

Figure 7:
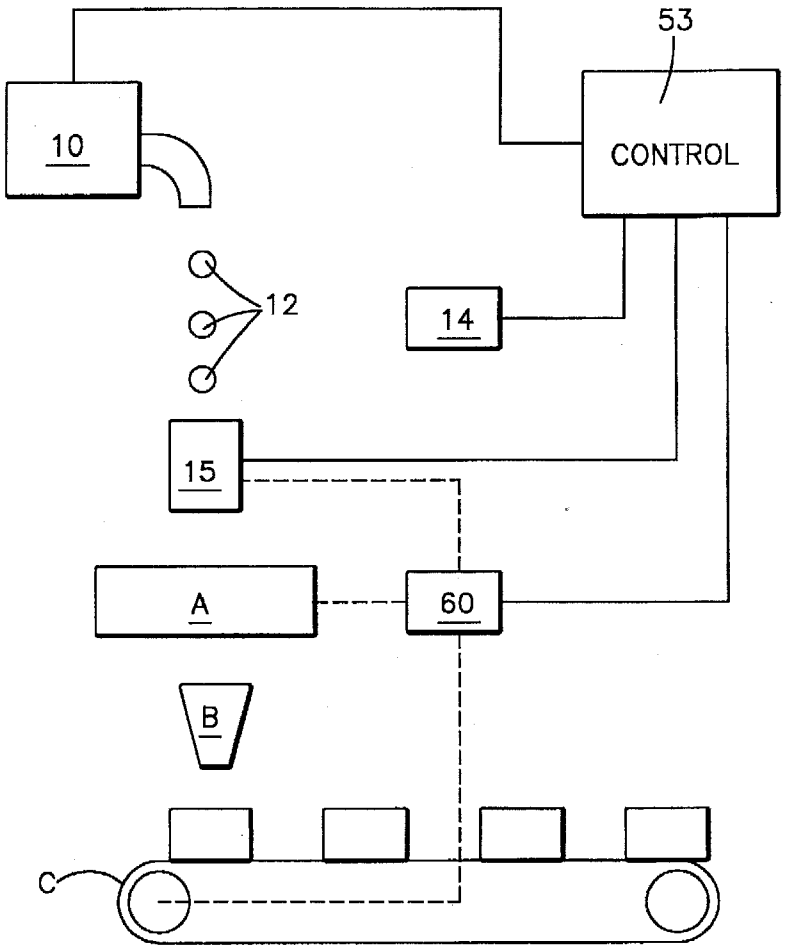

Items dispensed by the feeder pass into and through an accumulator/separator 15 and thence to a receptacle shown schematically at 16. As indicated previously, the receptacle may be a bucket conveyor C, an accumulator A, a bag B at a bagger load station, or other packaging container such as a bottle, FIG. 7.

The accumulator/separator 15 includes a housing 18 delineating a through vertically oriented passage 20. Items 12 enter the passage 20 through an inlet 22 and exit through an outlet 24 and then fall into the positioned receptacle 16.

A diverter 25 is mounted in the passage 20. The diverter or baffle 25 is pivotally supported at 26 by each of a spaced pair of supports 28. The diverter pivot 26 is immediately below the outlet 24. The supports 28 in turn are supported by pivots 30 connected to the housing 18 near the inlet 22.

Figure 5:
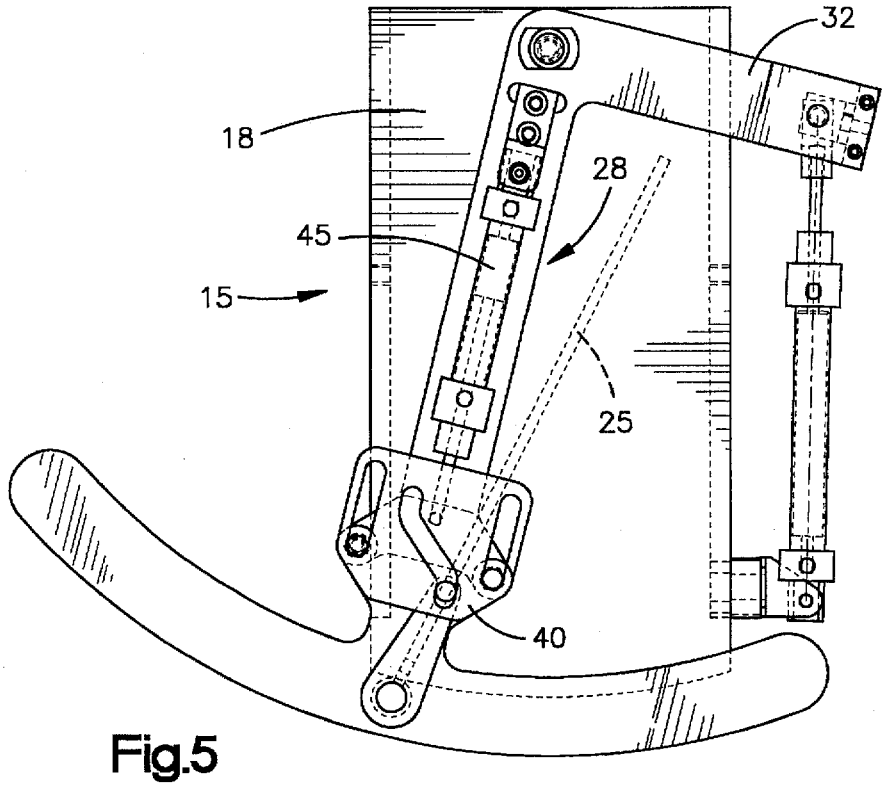

Each support 28 includes an actuator arm 32 extending orthoganally from a depending portion 34. An arm actuator 35 extends between an anchor 36 and the actuator arms 32. The anchor 36 is secured to the housing 18. The upper end of the arm actuator 35 is connected to the arms 32 by a cross arm 38. Actuation of the arm actuator 35 to extend it will shift the supports 28 to the position shown in FIGS. 2 and 3 while retraction of the arm actuator 35 shifts the supports 28 to the position shown in FIGS. 4 and 5.

Figure 6:
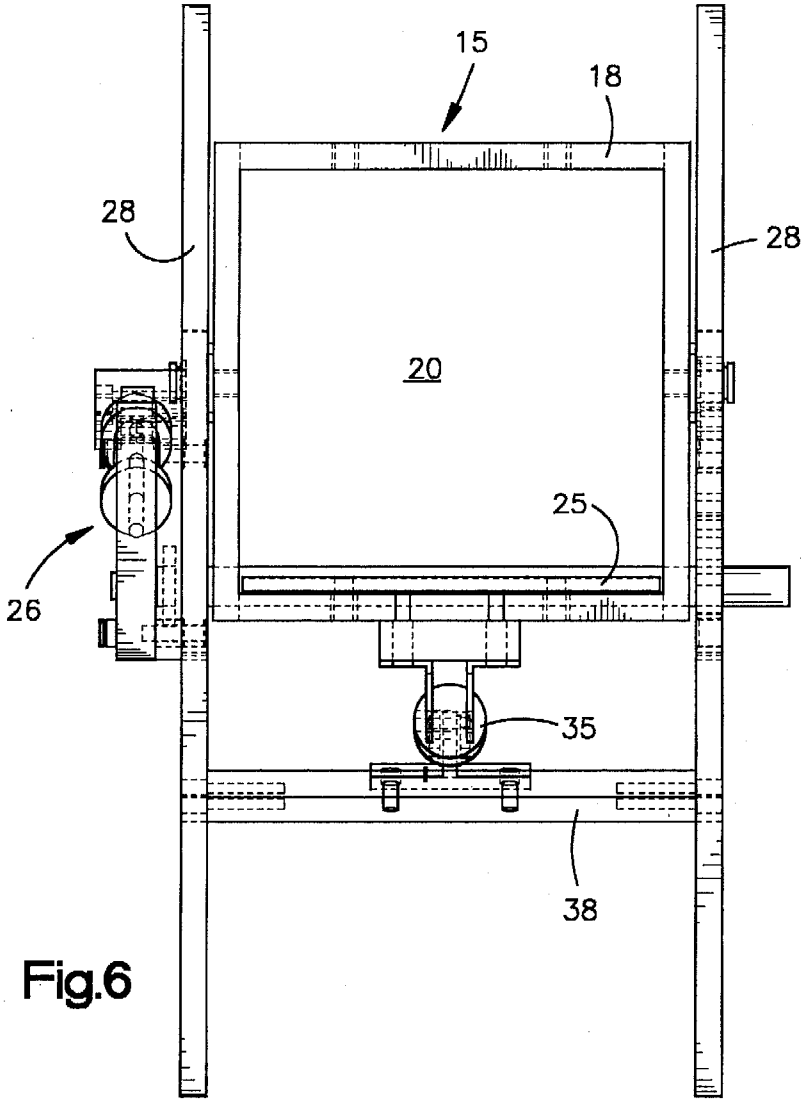
FIG. 6 is a bottom plan view of the accumulator/separator of this invention; and, FIG. 7 is a schematic view of the system.

A cam 40 is reciprocatively carried by the support which is visible in FIGS. 2–5 and is the left hand support in FIG. 6. A pair of cam guides 42 extend from the depending portion 34 of the support and project through cam slots 44. A cam actuator 45 is connected to the cam and to the support 28 for selectively shifting the cam up and down relative to the depending portion 34. The shifting is rectilinear motion controlled by coaction of the cam guides 42 and slots 44.

The cam 40 includes a diverter position control slot 46. A cam follower 48 extends into and coacts with the position slot 46. The cam follower 48 is carried by a follower arm 50 which is fixed to the diverter pivotor shaft 26. Actuation of the cam actuator 45 will shift the cam 40 between an upper position shown in FIGS. 3 and 4 and a lower position shown in FIGS. 2 and 5.

Operation

In operation the counter 14 is preset for the number of items to be collected in each sequential batch of items. The speed of the vibratory feeder 10 is then set to dispense items at a rate which will produce batches at the cycle rate of the receptacles 16. Thus, as an example, if a new receptacle 16 is to be positioned at the load station where it is shown in FIG. 1, once every five seconds, and five items 12 are to the preselected preset number of items for each batch, the feeder will be adjusted to dispense items at a rate of one per second. Once the counter has been set and the feed rates of receptacle positioning and vibratory feed have been coordinated, items are dispensed.

Figure 2:
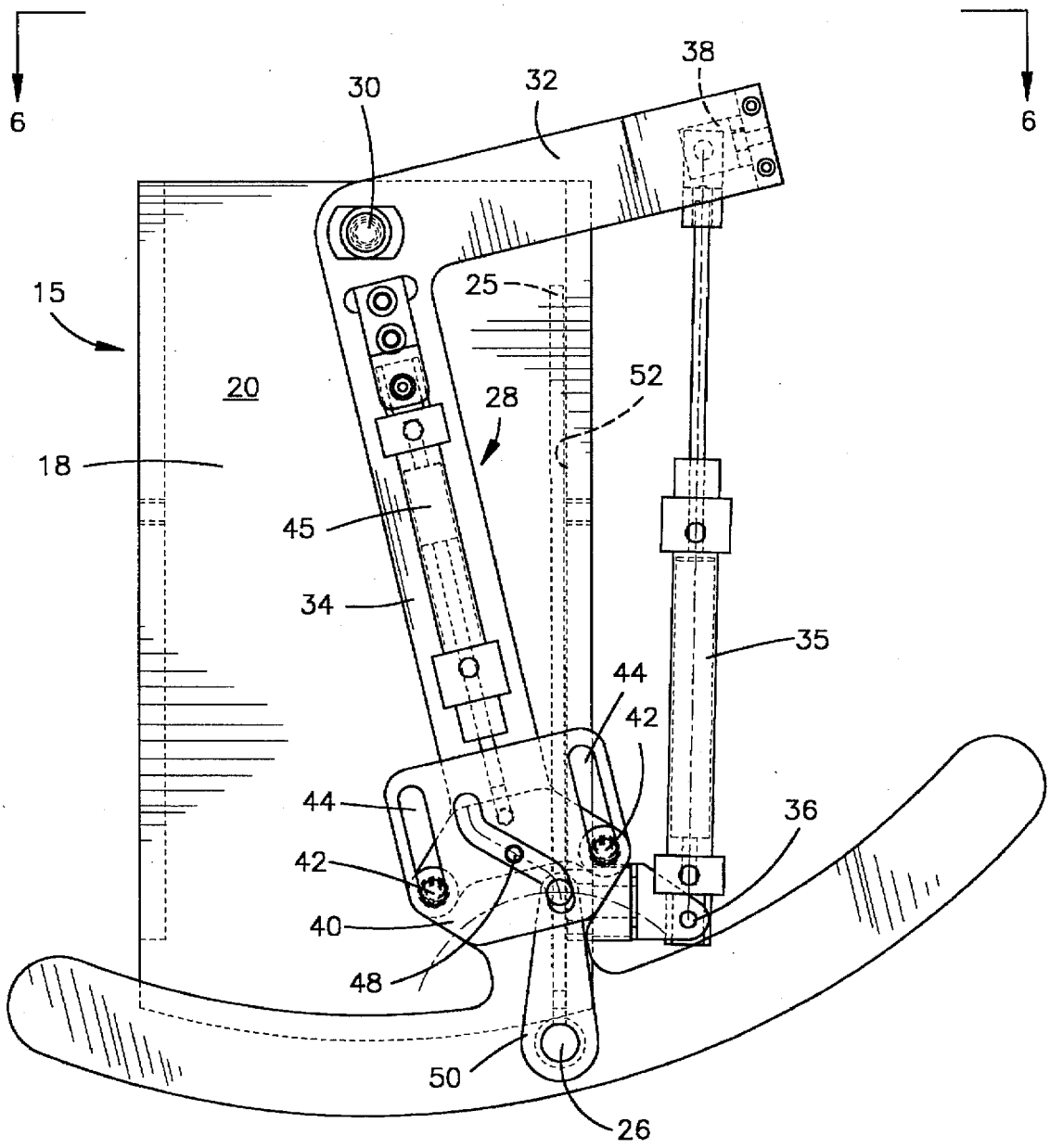

Assume the diverter to be initially in the position of FIG. 2 adjacent an end wall 52 which is the right hand end wall as viewed in FIG. 2. An empty receptacle 16 will at this juncture be positioned below the accumulator/separator 15. Items will then be dispensed and gravity flowed through the passage 20.

Figure 3:
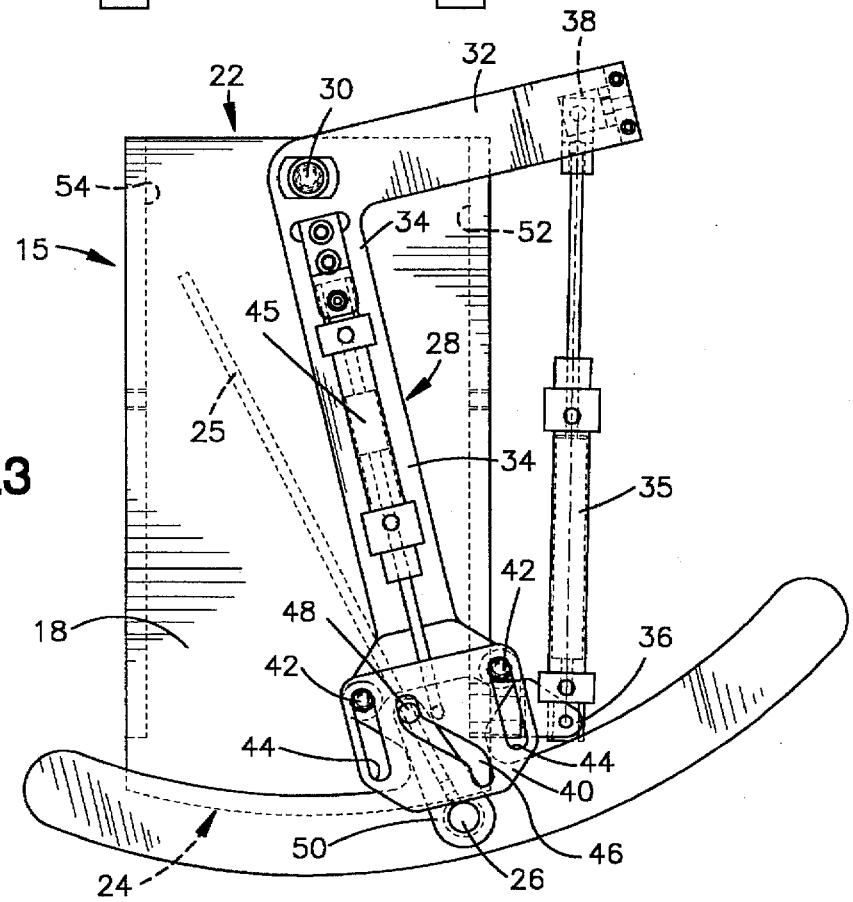
FIGS. 2–5 are elevational views showing sequentially the diverter in its four operating positions.

As the fifth or last item in our examplory batch is counted, a control 53 in response to a signal from the counter 14 will cause the cam actuator 45 to be energized to shift the cam 40 vertically from its position of FIG. 2 to the position of FIG. 3. In the FIG. 3 position, the diverter 25 extends laterally across the passage 20 to the other or left hand side wall 54 as seen in FIGS. 2–5. Since, as is best seen in FIG. 6, the diverter extends from close juxtaposition with a side wall 56 across the passage 20 to close juxtaposition with another side wall 58, following items will be collected above the diverter and between the diverter and the right hand end wall 52.

The timing of the movement of the diverter 25 from its FIG. 2 to its FIG. 3 position is such that if it strikes a dispensed item of the first batch at all, it will divert it downwardly toward the receptacle 16 without danger of it hitting the diverter and bouncing away from its intended feed into the receptacle 16. Items of the second batch will be collected on top of the diverter 25 until the receptacle 16 containing the first batch has been removed and an empty receptacle for the second batch is in position to receive it.

Figure 4:
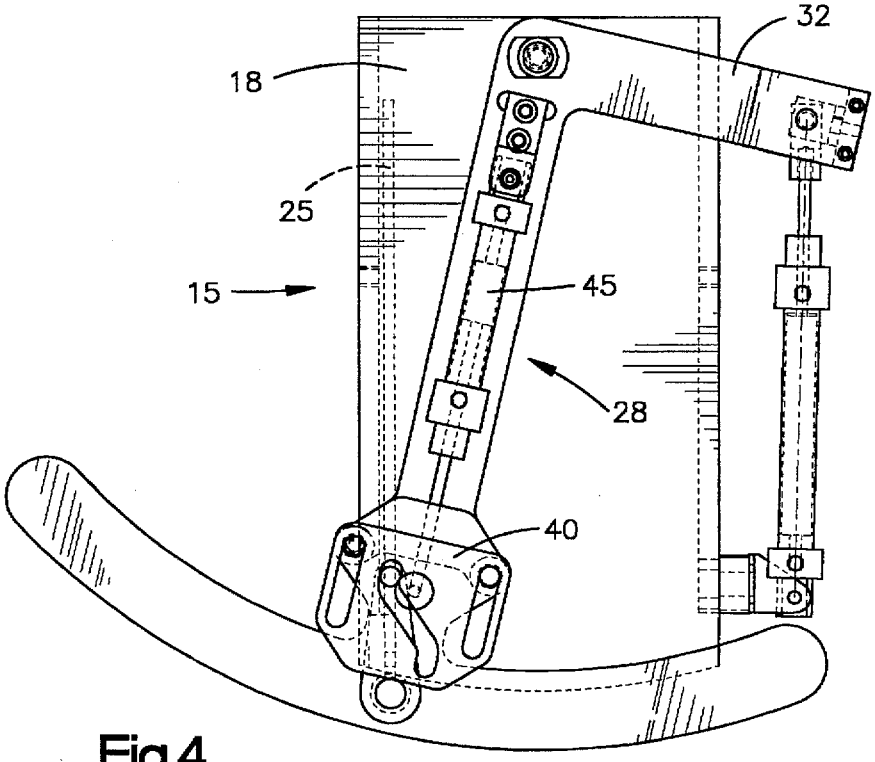

Once a receptacle ready signal is emitted by a receptacle sensor 60, the control 53 causes the arm actuator 35 to be energized to foreshorten it and shift the supports 28 from their positions of FIGS. 2 and 3 to the positions of FIG. 4. This results in the diverter being positioned parallel to and adjacent the left hand end wall 54 as shown in FIG. 4. Concurrently accumulated items of the second batch will be dropped through the outlet 24 into the second batch receptacle 16.

As the last items of the second batch is counted, a count complete signal is emitted by the counter 14. In response to the count complete signal the control 53 causes the cam actuator 45 to again be energized, this time to raise the cam and cause the diverter 25 to shift from the FIG. 4 position to the position of FIG. 5 where it extends diagonally across the passage. In the FIG. 5 position the pivot 26 adjacent the left hand end wall 54 while top of the diverter is adjacent the right hand end wall 52 to divert and collect a third batch.

As the third batch is being collected, the receptacle now containing the second batch is removed and a further receptacle is positioned at the load station. A further receptacle ready signal is emitted by the receptacle sensor 60. The receptacle ready signal results in the actuator 35 again being extended and in the process moving the support and diverter from the position of FIG. 5 back to the position of FIG. 2. As the count complete signal indicating the last item of the third batch has passed the counter 14, the cam actuator 45 is again energized to move the diverter 25 again to the position of FIG. 3 and the entire cycle is thereafter repeated sequentially.

At any time when the control 53 receives a signal from the counter 15 indicating a given batch is complete but the control has not received a receptacle ready signal from the sensor 60, the feeder 10 is stopped and the accumulator/separator is maintained in its existing position to retain the just completed batch. Once a receptacle ready signal is received one of the arm and cam actuators 35, 45 is actuated to discharge the retained batch. The other of the actuators is then actuated to position the diverter 25 across the passage 18 in a collection position and the feeder is restarted.

Although the invention has been described in its preferred form with a certain degree of particularity, it is understood that the present disclosure of the preferred form has been made only by way of example and that numerous changes in the details of construction, operation and the combination and arrangement of pans may be resorted to without departing from the spirit and the scope of the invention as hereinafter claimed.

I claim:

1. An accumulator for substantially continuously receiving serially dispensed items and separating the items into batches each containing a predetermined measure of items comprising:

a) an open ended tubular housing having a through opening defined in part by a spaced pair of side walls;

b) a diverter having at least a section positioned within the opening;

c) the section having:

i) a first position adjacent one of the side walls;

ii) a second position adjacent the other of the side walls;

iii) a third position extending across the opening from a location near a first end of the one side wall to a location near a second end of the other side wall; and, iv) a fourth position extending across the opening from a location near the first end of the other side wall to a location near the second end of the one side wall; and, d) prime mover means for shifting the section sequentially:

i) from the first position to the third position;

ii) from the third position to the second position;

iii) from the second position to the fourth position;

iv) from the fourth position back to the first position; and, v) thereafter repeating the sequence.

2. The accumulator of claim 1 wherein the first end is a lower end and the second end is an upper end of the opening.

3. In combination with the accumulator of claim 1 a receiving receptacle structure positioned to receive discharged batches from the accumulator and a receptacle structure condition sensor operably connected to the prime mover means to enable the prime mover means to effect section shifting only when the receptacle structure is in condition to receive a batch.

4. The combination of claim 3 wherein the receptacle structure is a conveyor having a plurality of receptacles.

5. The combination of claim 3 wherein the receptacle structure is a further accumulator.

6. The combination of claim 3 wherein the receptacle structure is a bag.

7. An accumulator for receiving and collecting batches of items being dispensed for facilitating subsequent processing of collected batches, the accumulator comprising:

a) a tubular body having spaced pairs of side and end walls delineating a through passage with input and output ends;

b) a baffle member movably mounted in the passage and having a lateral dimension slightly less than but substantially equal to the width of the passage between the end walls;

c) a baffle support pivotally mounted on the body at a mounting location above the outlet when the accumulator is in use;

d) the baffle support pivotally supporting the baffle at a pivot location below the outlet when the accumulator is in use;

e) a first prime mover mechanism operably connected to the body and the support for selectively shifting the support between a first position wherein the pivot location is near one of the side walls and a second position wherein the pivot location near the other of the side walls; and, f) a second prime mover mechanism for selectively causing pivotal movement of the baffle between a first position adjacent the one side wall and a second position across the passage and between a third position adjacent the other side wall and a fourth position across the passage.

8. The accumulator of claim 7 wherein the second prime mover mechanism includes a cam operably interposed between the baffle and the support.

9. The accumulator of claim 7 wherein each of the prime mover mechanisms includes a fluid cylinder.

10. The accumulator of claim 7 wherein the baffle support pivotal mounting is connected to an end wall.

11. The accumulator of claim 7 wherein there are a pair of baffle support pivotal mountings respectively connected to the end walls.

12. A method of collecting dispensed items in batches of predetermined numbers comprising:

a) serially and continuously dispensing and counting items;

b) gravity feeding dispensed items into an accumulator;

c) allowing dispensed items to pass through the accumulator until a first batch of a predetermined number of items has been counted;

d) as a last item of the first batch is being fed, shifting a diverter from an at least one discharge position to a collection position to divert subsequently dispensed items into a collection location within the accumulator;

e) collecting dispensed items in the collection location until a second batch of a predetermined number of items is collected;

f) as items of the second batch are being fed, shifting the diverter from its collection position to one said an at least one discharge position;

g) as the last item of the second batch is being fed shifting the diverter to a further collection position to divert subsequently dispensed items into another collection location within the accumulator; and, h) sequentially repeating steps (d), (e), (f) and (g).

13. The method of claim 12 wherein the first batch is dispensed into a receptacle commencing at least as early as when the diverter is in its said at least one discharge position.

14. The method of claim 12 further including delaying the diverter shifting as the last second batch item is dispensed until a receptacle ready condition is sensed.

15. A method of accumulating batches of items fed serially from a dispenser to sequentially supplied batch receiving receptacles comprising:

a) discharging items sequentially from the dispenser into a tubular accumulator having a through passage and a diverter within the passage;

b) positioning the diverter adjacent a first wall section of the accumulator to allow a first batch of items to pass through the accumulator to a positioned receptacle;

c) as the last item of the first batch passes through the accumulator shifting the diverter to a position across the passage to accumulate a second batch within the accumulator;

d) positioning a second receptacle to receive the second batch and thereafter shifting the diverter to position it adjacent another wall section and discharge the second batch into the second receptacle;

e) as the last item of the second batch passes through the accumulator shifting the diverter to a further position across the passage to accumulate a third batch within the accumulator;

f) positioning a third receptacle to receive the third batch and thereafter shifting the diverter to position it adjacent the first wall section and discharge the third batch into the third receptacle; and g) thereafter repeating steps (b), (c), (d), (e) and (f) to sequentially accumulate further batches.

16. A system for sequentially establishing batches of predetermined numbers of items comprising:

a) a feeder for continuously dispensing items serially and one at a time;

b) a counter for counting items as they are dispensed by the feeder and emitting a batch control signal each time a predetermined number of items has been dispensed by the feeder;

c) a tubular item separator defining a through passage for separating items fed on a continuous basis into batches, the separator including a diverter being pivotally mounted externally of the passage and extending into the passage for diverting items forming each succeeding batch to collection locations within the passage but separated from items of the batch immediately preceding each separated batch while maintaining all items along a flow path from the feeder through the passage and through a single passage outlet to a collection station, the diverter being operative to establish diversion of items of a succeeding batch in response to each such batch control signal; and, d) collection means at the collection station for sequentially collecting such batches and maintaining them in such separated condition.

17. The system of claim 16 further including a collection means condition sensor for emitting collection means condition signals according to the readiness of the collection means to receive batches of items from the item separator.

18. A batch separator for establishing batches of predetermined numbers of items dispensed serially from a feeder for sequential deposit in batches at a collection station, the improved separator comprising:

a) an apertured tube defining a through passage, the tube being for positioning around a single item path of travel from the feeder to the station;

b) a diverter mounted in the tube, the diverter being shiftable between a flow position out of the path and a collection position obstructing the path, the diverter when in the flow position permitting the flow of items to the station and when in the collection position interrupting such flow to accumulate a batch of a predetermined number of items within the tube; and, c) the diverter being connectable to a prime mover for shifting between its positions.

19. The separator of claim 18 further including a prime mover operably connected to the diverter for shifting the diverter between its positions in response to signals received from a counter.

20. The separator of claim 18 wherein the tube is positioned when in use around a vertical gravity induced path of item travel.

21. A separator for substantially continuously receiving serially dispensed items and separating the items into batches each containing a predetermined measure of items comprising:

a) an open ended tubular housing having a through opening defined in part by a spaced pair of side walls;

b) a diverter having at least a section positioned within the opening; and, c) the section having:

i) a first position adjacent one of the side walls;

ii) a second position adjacent the other of the side walls;

iii) a third position extending across the opening from a location near a first end of the one side wall to a location near a second end of the other side wall; and, d) a fourth position extending across the opening from a location near a first end of the other side wall to a location near a second end of the one side wall.

22. The accumulator of claim 21 wherein the first end is a lower end and the second end is an upper end of the opening.

23. An accumulator for receiving and collecting batches of items being dispensed for facilitating subsequent processing of collected batches, the accumulator comprising:

a) a tubular body having spaced pairs of side and end walls delineating a through passage with input and output ends;

b) a baffle member movably mounted in the passage and having a lateral dimension slightly less than but substantially equal to the width of the passage between the end walls;

c) a baffle support pivotally mounted on the body at a mounting location above the outlet when the accumulator is in use; and, d) the baffle support pivotally supporting the baffle at a pivot location below the outlet when the accumulator is in use.

24. The accumulator of claim 23 wherein the baffle support pivotal mounting is connected to an end wall.

25. The accumulator of claim 23 wherein there are a pair of baffle support pivotal mountings respectively connected to the end walls.

26. A batch separator for establishing batches of predetermined numbers of items dispensed serially from a feeder for sequential deposit in batches at a collection station, the improved separator comprising:

a) an apertured tube defining a through passage, the tube being for positioning around a single item path of travel from the feeder to the station;

b) a diverter mounted in the tube, the diverter being shiftable between a flow position out of the path and a collection position obstructing the path, the diverter when in the flow position permitting the flow of items to the station and when in the collection position interrupting such flow to accumulate a batch of a predetermined number of items;

c) the diverter being connectable to a prime mover for shifting between its positions; and, d) the through passage being defined in part by a spaced pair of side walls;

the diverter having at least a section positioned within the opening; and, the section has:

i) a first position adjacent one of the side walls;

ii) a second position adjacent the other of the side walls;

iii) a third position extending across the opening from a location near a first end of the one side wall to a location near a second end of the other side wall.

27. A batch separator for establishing batches of predetermined numbers of items dispensed serially from a feeder for sequential deposit in batches at a collection station, the improved separator comprising:

a) an apertured tube defining a through passage, the tube being for positioning around a single item path of travel from the feeder to the station;

b) a diverter mounted in the tube, the diverter being shiftable between a flow position out of the path and a collection position obstructing the path, the diverter when in the flow position permitting the flow of items to the station and when in the collection position interrupting such flow to accumulate a batch of a predetermined number of items;

c) the diverter being connectable to a prime mover for shifting between its positions; and, d) the tube having spaced pairs of side and end walls delineating the through passage and the tube passage having input and output ends;

e) the diverter having a lateral dimension slightly less than but substantially equal to the width of the passage between the end walls;

f) a diverter support pivotally mounted on the tube at a mounting location above the outlet end when the accumulator is in use; and, g) the diverter having a support pivotally supporting the diverter at a pivot location below the outlet when the accumulator is in use.

* * * * *